US007628217B2

(12) United States Patent
Crippen

(10) Patent No.: US 7,628,217 B2
(45) Date of Patent: Dec. 8, 2009

(54) FIRE SUPPRESSION APPARATUS

(76) Inventor: Dan L. Crippen, 5137 Massachusetts Ave., Bethesda, MD (US) 20816

( * ) Notice: Subject to any disclaimer, the term of this patent is extended or adjusted under 35 U.S.C. 154(b) by 0 days.

(21) Appl. No.: 12/016,781

(22) Filed: Jan. 18, 2008

(65) Prior Publication Data

US 2008/0110646 A1 May 15, 2008

Related U.S. Application Data

(63) Continuation of application No. 10/989,545, filed on Nov. 17, 2004, now abandoned.

(60) Provisional application No. 60/520,307, filed on Nov. 17, 2003.

(51) Int. Cl.
*A62C 25/00* (2006.01)

(52) U.S. Cl. ..... 169/51; 312/284; 312/285

(58) Field of Classification Search ..... None
See application file for complete search history.

(56) References Cited

U.S. PATENT DOCUMENTS 4,046,439 A 9/1977 Lee
4,062,607 A 12/1977 Locatelli
4,125,084 A 11/1978 Salmonsen et al.
5,184,684 A 2/1993 Kohlman
5,195,595 A 3/1993 Nakagawa
5,775,430 A 7/1998 McSheffrey
5,902,028 A 5/1999 Hsu et al.
5,975,475 A * 11/1999 Chaplin ..... 248/311.2

* cited by examiner

*Primary Examiner*—Dinh Q Nguyen
(74) *Attorney, Agent, or Firm*—Crowell & Moring LLP

(57) ABSTRACT

A container for a fire extinguisher intended to enable a fire extinguisher to be placed in a convenient location in a kitchen or next to a fireplace, while at the same time providing an attractive appearance. The precise configuration of the container can vary, but it typically includes a base about one half to two thirds the height of the extinguisher and a cover with an easily gripped handle which fits over the extinguisher is seated on the base. The container may have a round, hexagonal, square or rectangular cross-section. Various types of external ornamentation, such as ceramic tile, can be provided on exposed surfaces. A time clock may be included to provide periodic reminders to check on the operational status of the extinguisher. The exterior of the container may be augmented with pegs for hanging utensils, or magnetic or corkboard surfaces for pictures, notes, etc.

17 Claims, 5 Drawing Sheets

FIRE SUPPRESSION APPARATUS

This is a continuation of application Ser. No. 10/989,545 filed Nov. 17, 2004, which was based on provisional Ser. No. 60/520,307 filed Nov. 17, 2003, the priority of both of which are claimed, and the entire contents of both of which are incorporated herein by reference.

The present invention relates to a fire suppression apparatus comprising a fire extinguisher and a container therefor.

Structure fires frequently commence in occupied spaces such as kitchens, bedrooms and/or rooms with fireplaces. Typically, such fires commence as small blazes, which if promptly attacked with an appropriate fire extinguisher, can be readily extinguished before extensive damage occurs. Consequently, it is desirable to have fire extinguishers readily available wherever a fire could possibly start.

Inhabited spaces such as kitchens, bedrooms, family rooms, and the like are typically decorated to present a pleasing appearance. As most fire extinguishers are designed for functional purposes and to be highly visible, they do not blend well with typical room decor. As a result, fire extinguishers tend either to be stored in remote locations where they may be inaccessible or omitted altogether.

It would be highly desirable if a fire extinguisher could be placed in a convenient, visible and readily accessible location in a decorated room, such as a kitchen, bedroom or family room, without disturbing the pleasing decorative appearance of the area.

SUMMARY OF THE INVENTION

Accordingly, it is an object of the invention to provide a fire suppression apparatus comprising a fire extinguisher and a container therefor which provides a pleasing appearance while maintaining ready accessibility to the extinguisher.

A further object of the invention is to provide a fire suppression apparatus which provides periodic reminders to a property owner or manager to verify the operability of the extinguisher.

Yet another object of the invention is to provide a fire suppression apparatus with improved stability.

A still further object of the invention is to provide a fire suppression apparatus which also can serve as a support or holder for additional devices typically needed in areas such as kitchens or adjacent fireplaces.

These and other objects are achieved in accordance with the present invention by providing a fire suppression apparatus comprising a container comprising a hollow base having a bottom, an upstanding surrounding wall, and a top opening; and a cover having a top, a depending surrounding wall, and a bottom opening; said cover being supported on said base in registration with the top opening thereof to define an enclosed hollow chamber in said container, and said cover being freely openable; and a fire extinguisher disposed in the hollow chamber in said container and having a grip or handle on an upper portion thereof; wherein the upstanding surrounding wall of said base has a height such that said upstanding wall ends below the grip or handle of said fire extinguisher.

Further objects are achieved in accordance with preferred aspects and features of the invention described in detail hereinafter.

In one preferred embodiment the cover rests upon the base and is freely removable from the base to open said container.

According to another preferred embodiment, the upstanding surrounding wall of the container base has a height from about one-half to about two-thirds that of the fire extinguisher. This assures that when the cover is removed from the container, the grip or handle on the upper portion of the fire extinguisher will be readily accessible.

In accordance with another preferred embodiment of the invention, the cover is provided with an easily gripped handle for facilitating rapid removal of the cover from the container base.

The base and cover may be made of any suitable material having sufficient strength and durability to form a useful container. Examples of suitable materials include wood, metal, ceramics, and plastics (i.e., synthetic resins). Preferably, the base and/or the cover is provided with positioning guides for facilitating proper alignment of the cover with the base and maintaining the cover in the desired position on the base until it is intended to be removed by a user of the apparatus. Preferred positioning guides take the form of upward projections from the base which are received in the cover or downwardly projecting portions from the cover which are received in the base. For example, advantageous positioning guides may be provided by disposing a pair of upwardly projecting rods in opposed corners of the base, so that they are received in the mating opposed corners of the cover. Of course, other possible positioning guide configurations will be apparent to persons skilled in the container art.

The base and cover may have any desired configuration, so long as they define a chamber suitable for housing a desired fire extinguisher. Typically, the container will have a circular or polygonal cross-section such as a square or a hexagon.

In accordance with one preferred embodiment, the bottom of the base may be weighted to stabilize the container. This measure lowers the overall center of gravity of the apparatus and renders the apparatus more resistant to inadvertent tipping in a moment of excitement.

In preferred embodiments, the external surfaces of the base and cover may be faced with ornamental materials such as ceramic tiles and/or embossed metal.

In further preferred embodiments of the invention, the container may serve an additional purpose of providing a mount or support for other items. For example, an exposed external surface of the base may be faced with a magnetic material, so that items such as pictures, notices, reminder notes, etc. can be conspicuously affixed to the surface of the container by small magnets. Alternatively, the exposed external surface of the base may be faced with a bulletin board material penetrable by pins or thumbtacks, such as cork board, so that items can be pinned or tacked to the exterior of the base. In another preferred embodiment, hooks or pegs may be provided on the exterior of the base on which small items such as kitchen utensils or fireplace tools may be hung. In yet another desirable embodiment, a receptacle for useful items, such as a match container, can be affixed to the exterior of the base. It is preferred that items supported on or by the container be disposed on the base, so that they cannot interfere with removal of the cover and accessibility of the fire extinguisher in an emergency situation.

In yet another preferred embodiment of the invention, the container further comprises an electronic clock or timer which provides periodic reminders to a user to check the fire extinguisher and verify that it is fully charged and operational. Alternatively, the container could be provided with a receiver and display which receive and display a signal emitted by a transponder chip on the fire extinguisher indicating the operational status of the fire extinguisher.

BRIEF DESCRIPTION OF THE DRAWINGS

The invention will be described in further detail hereinafter with reference to illustrative preferred embodiments shown in the accompanying photographic drawings in which.

DETAILED DESCRIPTION OF PREFERRED EMBODIMENTS

Figure 1:
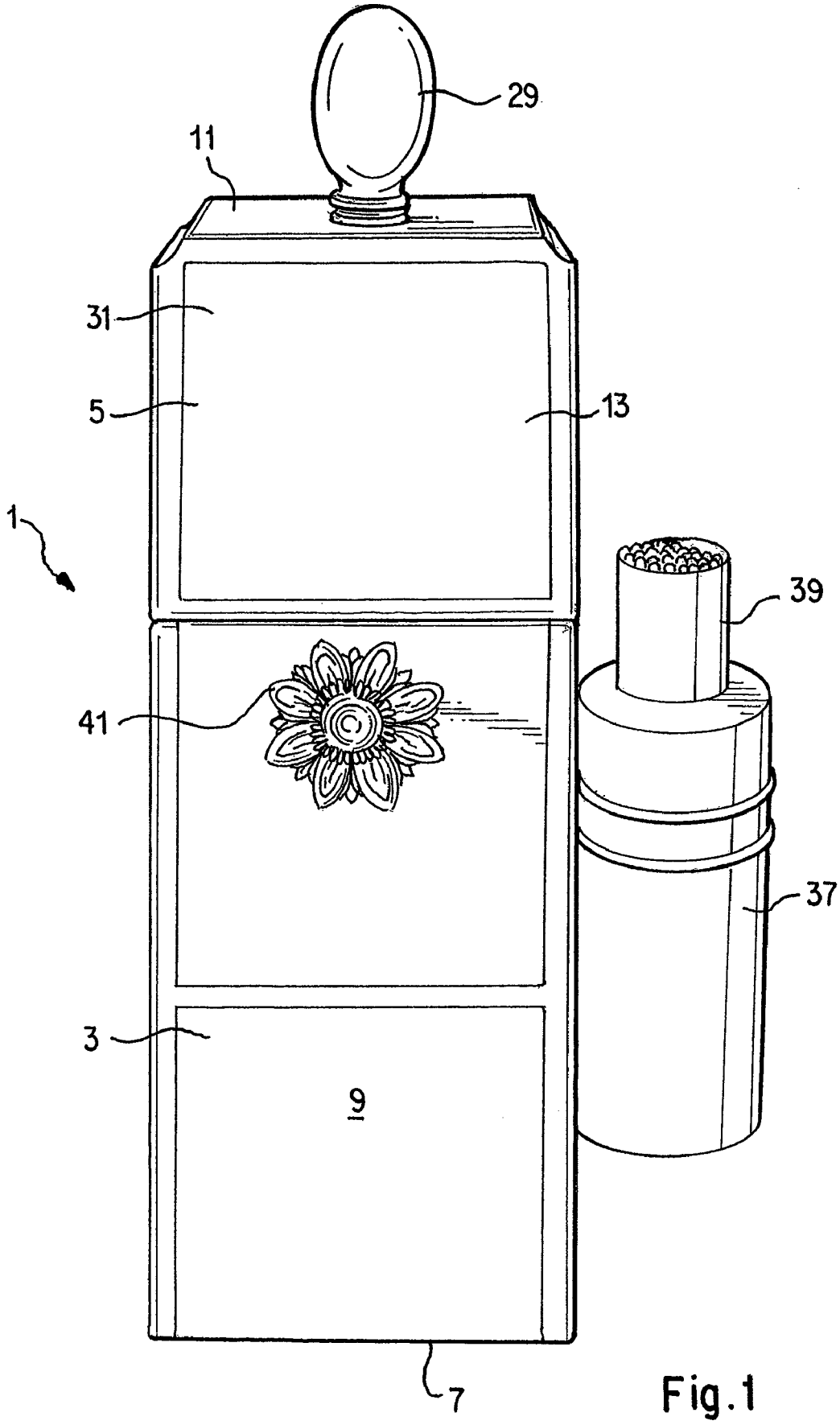
FIG. 1 is a perspective view of a first fire suppression apparatus embodiment according to the present invention.

FIG. 1 shows a first embodiment of a fire suppression apparatus 1 according to the present invention comprising a base 3 and a cover 5. Base 3 comprises a bottom 7 and an upstanding surrounding side wall 9. Cover 5, in turn, comprises a top 11 and a depending surrounding wall 13. As seen more clearly in FIG. 2, base 3 is hollow, as is likewise cover 5. As illustrated in FIG. 1, cover 5 rests on top of base 3 in registration with the top opening 15 thereof so that together the base and cover define an enclosed hollow chamber. As seen more clearly from FIG. 2, cover 5 is removable from base 3 to open the container.

Apparatus 1 further comprises a fire extinguisher 17 with a grip or handle 19 on an upper portion thereof. By withdrawing a safety lock 21 and depressing an actuator 23 associated with handle 19, the fire extinguisher can be operated in an emergency situation to discharge a fire extinguishing medium, in this case a fire extinguishing foam, which is dispensed through a nozzle 25. A pressure gauge 27 on the fire extinguisher displays the operational readiness of the extinguisher. To facilitate illustration, fire extinguisher 17 is shown in FIG. 2 removed from the hollow chamber defined by base 3 and cover 5, but it is understood that except during emergency use or routine maintenance, the fire extinguisher will be disposed in the hollow chamber inside the container comprised of base 3 and cover 5.

To facilitate ready removal of the cover from the base in order to provide access to fire extinguisher 17, cover 5 optionally may be provided with an easy-grip handle 29.

Figure 2:
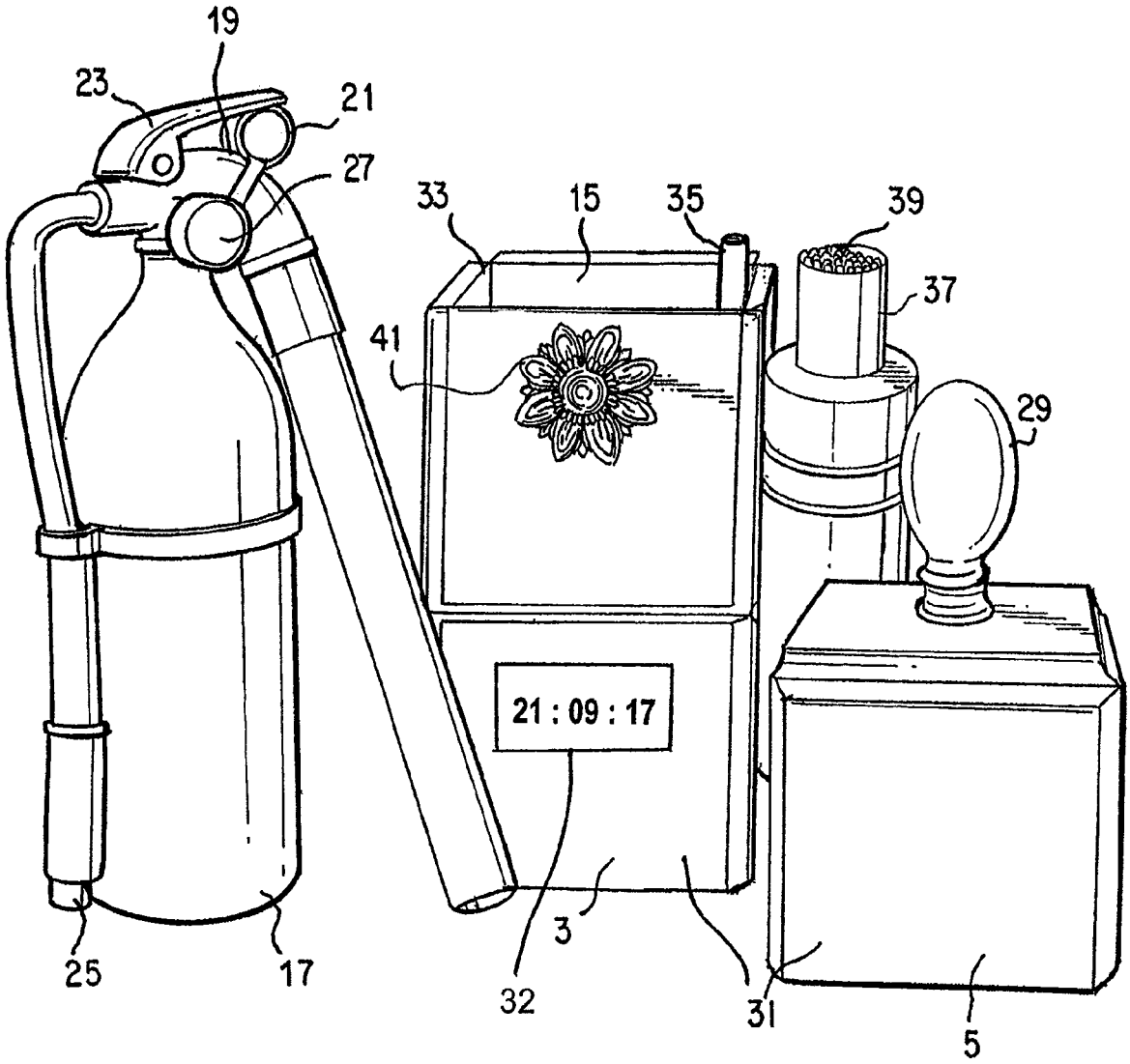
FIG. 2 is a second perspective view of the fire suppression apparatus of FIG. 1 with the cover off and the fire extinguisher removed from the base.

As seen more clearly in FIG. 2, the base is constructed as a wooden box with an open top. Cover 5 is similarly constructed as a wooden box 33 with no bottom. The exposed exterior surfaces of the base and cover are faced with ceramic tile 31, to provide a particularly pleasing external appearance. Additionally, the fire suppression apparatus 1 may include an electronic clock or timer 32, which provides periodic reminders to a user to check the fire extinguisher. The timer 32 may be located on the base 3 or any other portion of the fire suppression apparatus 1.

Base 3 is provided with two upwardly extending rods or pins 35 arranged in opposite corners of the hollow interior. When cover 5 is placed in the desired closed position on top of base 3 in registration with top opening 15, the pins 35 are received in the corresponding corners of the cover and serve as positioning guides to assure proper positioning of the cover, as well as preventing it from being accidentally dislodged if the container is bumped.

Base 3 also serves as a support for additional useful articles. In the embodiment of FIGS. 1 and 2, a receptacle 37 is affixed to the side wall of the base. In this embodiment, receptacle 37 serves as a holder for a container of fireplace matches 39.

To enhance the decorative appearance of the container, additional ornamentation 41 may be provided, if desired.

Figure 3:
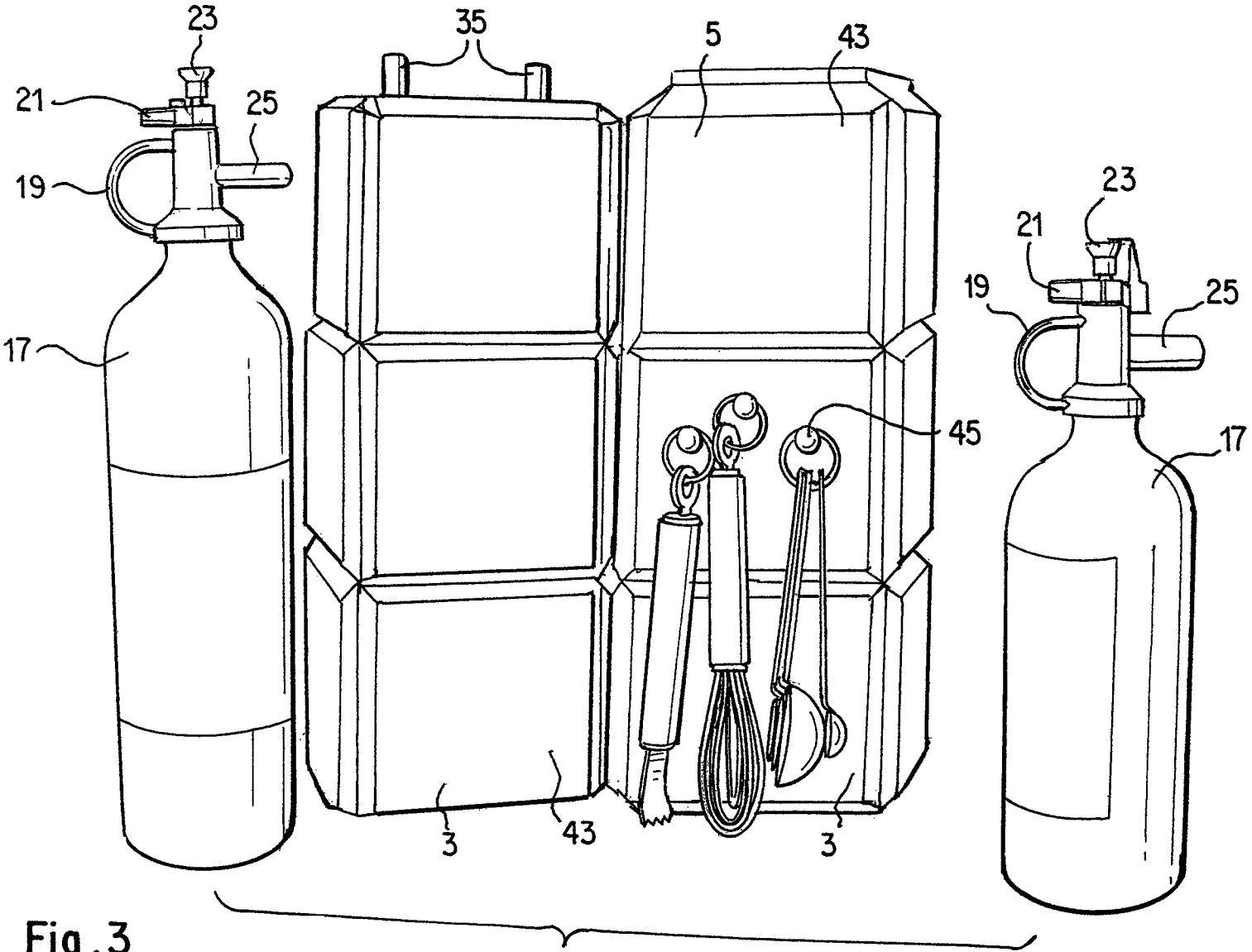
FIG. 3 is a perspective view of two alternate embodiments of the fire suppression apparatus of the invention, including one in which the base of the container is used as a support for additional items.

FIG. 3 shows alternative embodiments of the fire suppression apparatus of the invention. In these embodiments, similar parts are identified by like reference numerals. Again, for purposes of illustration, the fire extinguishers 17 are shown removed from the hollow interior chambers in which they are normally stored. As in the case of the first embodiment, the fire extinguishers have grips or handles 19 on upper portions thereof, as well as safety locks 21, actuators 23, and outlet nozzles 25.

Two container embodiments are shown, which are similar except for differing in height. The taller container base 3 at the left is shown without any cover, so that the positioning guides 35 protruding from the top are clearly visible. The exposed exterior surfaces are faced with a penetrable bulletin board material, in this case pieces of cork board 43, so that notes, photographs or the like can be posted on the outer surface of the base by means of pins or thumbtacks.

On the outer wall of the shorter container base at the right, pegs are provided on which kitchen utensils such as a stirring whisk or measuring spoons can be hung. In the illustrated embodiment, three such pegs are shown, but it will be appreciated that a greater or lesser number could be provided without departing from the scope of the invention.

Figure 4:
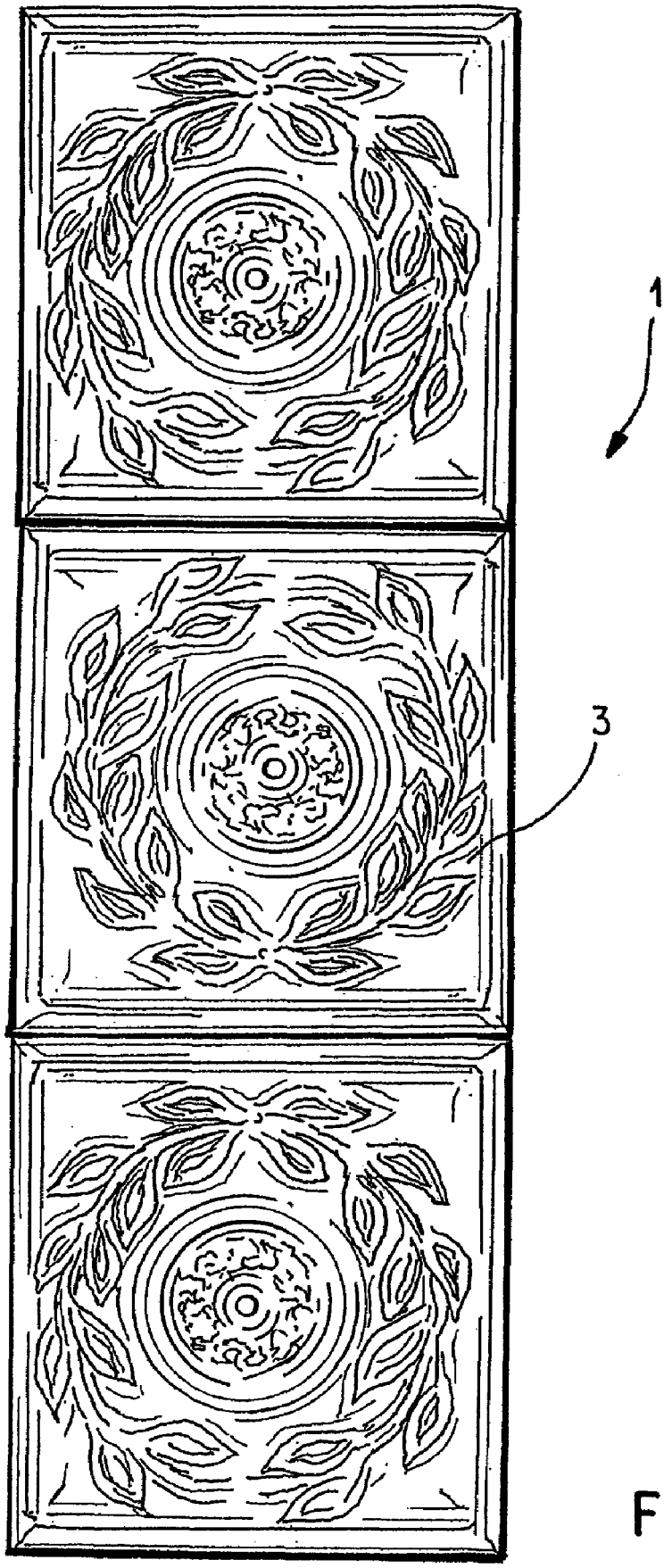
FIG. 4 is an elevational view of a further preferred embodiment of the fire suppression apparatus of the invention.

FIG. 4 depicts another embodiment of a fire suppression apparatus according to the invention. In this case the exterior surfaces of base 3 and cover 5 are faced with metal which has been embossed to provide an ornamental appearance. As in the other embodiments, cover 5 is readily removable to provide access to a fire extinguisher stored in the hollow chamber inside the container. The height of the base 3 is approximately two-thirds the height of the overall container, so that when cover 5 is removed, the grip or handle on the upper portion of the fire extinguisher stored within the container will be readily accessible.

Figure 5:
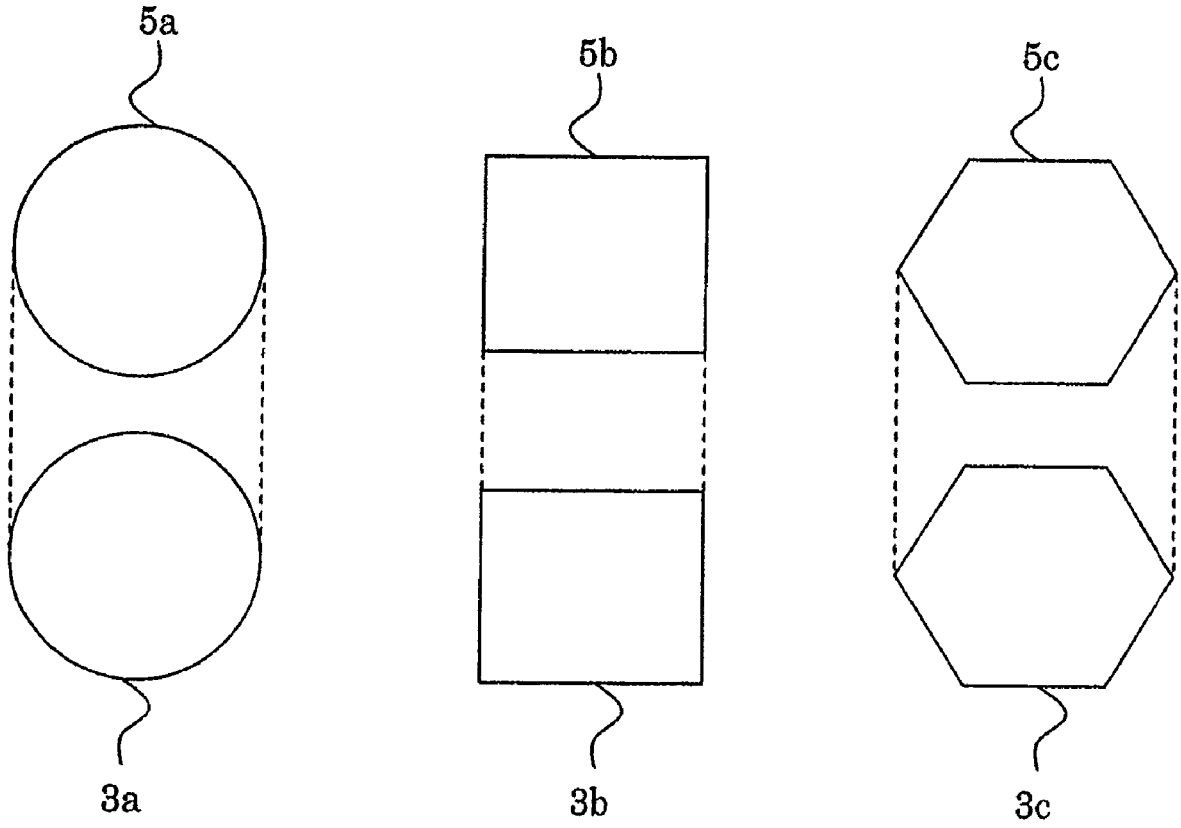
FIG. 5 illustrates embodiments of the cover and base having circular, square and hexagonal mating cross-sections.

FIG. 5 illustrates embodiments of the cover and base having circular, square and hexagonal mating cross-sections. An embodiment of the cover and base having circular mating cross-sections 5*a* and 3*a*, respectively, is shown on the left side of FIG. 5. An embodiment of the cover and base having square mating cross-sections 5*b* and 3*b*, respectively, is shown in the center of FIG. 5. An embodiment of the cover and base having hexagonal mating cross-sections 5*c* and 3*c*, respectively, is shown on the right side of FIG. 5.

The fire suppression apparatus of the invention enables a fire extinguisher to be placed in a highly visible and accessible location without adversely affecting the decorative appearance of a room in which it is disposed. Ready access to the extinguisher may be had by simply removing the cover. As a result, fire extinguishers are more likely to be stored in the immediate vicinity of a kitchen stove or a family room fireplace where a fire could break out, so that they would be quickly available for promptly suppressing any fire before it can grow out of control.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

What is claimed is:

1. A fire suppression apparatus comprising:

(a) a container comprising:

a hollow base having a bottom, an upstanding surrounding wall, and a top opening; and a cover having a top, a depending surrounding wall, and a bottom opening;

said cover being supported on said base in registration with the top opening thereof to define an enclosed hollow chamber in said container, and said cover being freely openable;

wherein said cover rests directly on said base and is freely removable from the base to open the container, and further comprising a handle on said cover for facilitating rapid removal of said cover from said base; and (b) a fire extinguisher disposed in the hollow chamber in said container and having a grip or handle on an upper portion thereof;

wherein the upstanding surrounding wall of said base has a height such that said upstanding wall ends below the grip or handle of said fire extinguisher.

2. An apparatus according to claim 1, wherein said upstanding surrounding wall has a height from about one-half to about two-thirds that of the fire extinguisher.

3. An apparatus according to claim 1, wherein said base and said cover are made of a material selected from the group consisting of wood, metal, ceramic and synthetic resin.

4. An apparatus according to claim 1, wherein at least one of said base and said cover is provided with positioning guides for maintaining proper alignment of said cover on said base.

5. An apparatus according to claim 4, wherein said positioning guides comprise a plurality of rods projecting upwardly from the top of said base into said cover.

6. An apparatus according to claim 1, wherein said fire extinguisher further comprises an actuator for operating said fire extinguisher.

7. An apparatus according to claim 6, wherein said actuator is a trigger which can be pulled by a finger of a hand gripping said grip or handle.

8. An apparatus according to claim 1, wherein said base and cover have mating circular or polygonal cross-sections.

9. An apparatus according to claim 8, wherein said base and cover have mating square or hexagonal cross-sections.

10. An apparatus according to claim 9, wherein the bottom of said base is weighted to stabilize the container.

11. An apparatus according to claim 1, wherein at least a portion of exposed external surfaces of said base and cover are faced with ceramic tiles.

12. An apparatus according to claim 1, wherein at least a portion of exposed external surfaces of said base and cover are faced with embossed metal.

13. An apparatus according to claim 1, wherein at least one exposed external surface of said base is faced with magnetic material, whereby items can be magnetically affixed to the exterior of the base.

14. An apparatus according to claim 1, wherein at least one exposed external surface of said base is faced with bulletin board material penetrable by pins or thumbtacks, whereby items can be pinned or tacked to the exterior of the base.

15. An apparatus according to claim 1, further comprising hooks or pegs on an exterior surface of said base, whereby items can be hung on said base.

16. An apparatus according to claim 1, further comprising a receptacle affixed to an exterior surface of said base, whereby items can be disposed on said container.

17. An apparatus according to claim 1, further comprising a timer for providing periodic reminders to check the operational status of the fire extinguisher.

* * * * *